US010738783B2

(12) United States Patent
Viargues et al.

(10) Patent No.: US 10,738,783 B2
(45) Date of Patent: Aug. 11, 2020

(54) CRYOGENIC INSTALLATION COMPRISING A CIRCULATOR

(71) Applicant: COMMISSARIAT A L'ENERGIE ATOMIQUE ET AUX ENERGIES ALTERNATIVES, Paris (FR)

(72) Inventors: François Viargues, Fontaine (FR); Gérard Marzo, Grenoble (FR); Bertrand Rollet, Chambéry (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 32 days.

(21) Appl. No.: 15/933,718

(22) Filed: Mar. 23, 2018

(65) Prior Publication Data

US 2018/0283381 A1 Oct. 4, 2018

(30) Foreign Application Priority Data

Mar. 24, 2017 (FR) ..... 17 52490

(51) Int. Cl.

| | |
|---|---|
| ***F04D 13/02*** | (2006.01) |
| ***F04D 7/02*** | (2006.01) |
| ***F25B 25/00*** | (2006.01) |
| ***F04D 29/42*** | (2006.01) |
| ***F04D 29/049*** | (2006.01) |
| ***F25B 9/14*** | (2006.01) |
| ***F04D 13/06*** | (2006.01) |

(Continued)

(52) U.S. Cl.

CPC ..... *F04D 13/024* (2013.01); *F04D 7/02* (2013.01); *F04D 13/0606* (2013.01); *F04D 29/049* (2013.01); *F04D 29/42* (2013.01); *F25B 9/145* (2013.01); *F25B 25/005* (2013.01); *F04B 2015/081* (2013.01); *F25D 17/02* (2013.01)

(58) Field of Classification Search

CPC ..... F04D 13/024; F04D 29/049; F04D 29/42; F04D 13/0606; F04D 7/02; F25B 9/14; F25B 25/005; F25D 17/02; F04B 2015/081

USPC ..... 62/6

See application file for complete search history.

(56) References Cited

U.S. PATENT DOCUMENTS 4,487,557 A 12/1984 Ruyak et al.
6,213,736 B1 * 4/2001 Weisser ..... F04D 13/083 417/410.1

(Continued)

FOREIGN PATENT DOCUMENTS

EP 1519124 A2 3/2005
EP 2306028 A2 4/2011

OTHER PUBLICATIONS

French Search Report and Written Opinion dated Jul. 21, 2017 issued in counterpart application No. FR1752490; w/ English machine translation (17 pages).

*Primary Examiner* — Steve S Tanenbaum
(74) *Attorney, Agent, or Firm* — Seckel IP, PLLC

(57) ABSTRACT

The invention concerns a circulator (2) for circulating a refrigerant fluid (4) in a circuit (6) of a cryogenic installation (1) from and to an element (3) having a thermal load, the circulator (2) including a drive module (8*a*, 8*b*) and a pumping module (9*a*, 9*b*) including a centrifugal wheel (10), said drive module (8*a*, 8*b*) having a magnetic coupling (51) to said pumping module (9*a*, 9*b*) in order to drive said centrifugal wheel (10) in a rotary movement.

20 Claims, 2 Drawing Sheets

Figure 1:
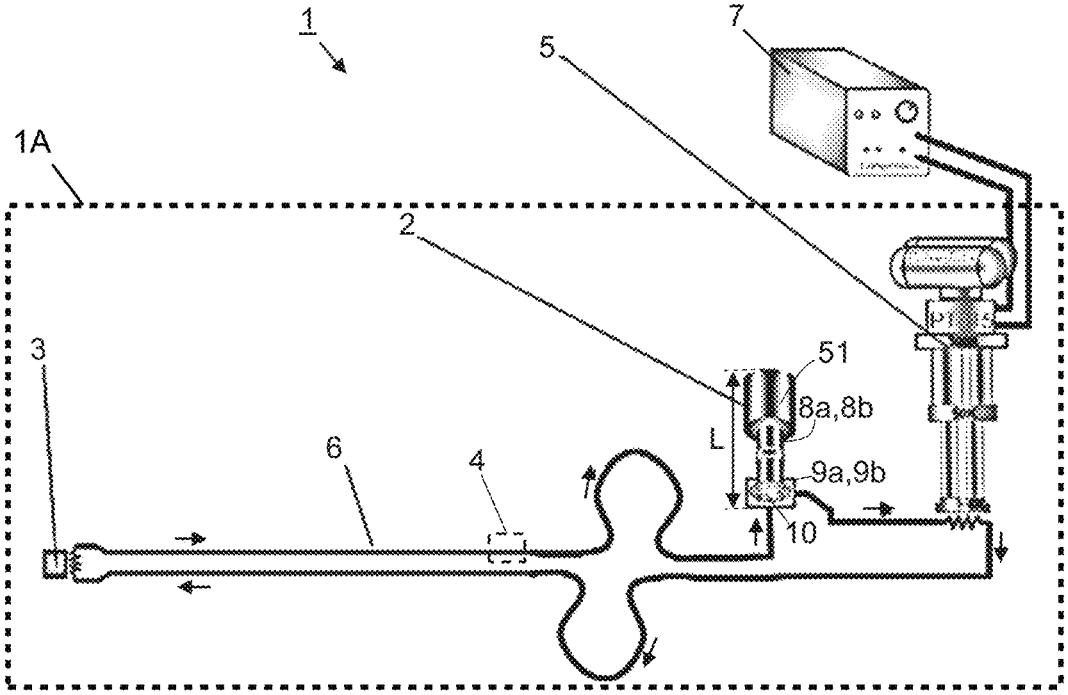

(51) Int. Cl.
*F25D 17/02* (2006.01)
*F04B 15/08* (2006.01)

(56) References Cited

U.S. PATENT DOCUMENTS

| | | | | |
|---|---|---|---|---|
| 2005/0061006 | A1* | 3/2005 | Bonaquist ..... | F25D 17/02 62/6 |
| 2006/0127253 | A1 | 6/2006 | Ekberg et al. | |
| 2006/0130493 | A1 | 6/2006 | Strobel | |
| 2010/0156220 | A1 | 6/2010 | Ekberg et al. | |
| 2013/0106018 | A1 | 5/2013 | Ekberg et al. | |
| 2015/0143822 | A1 | 5/2015 | Chalmers et al. | |

* cited by examiner

CRYOGENIC INSTALLATION COMPRISING A CIRCULATOR

The present application claims the priority of French application No. FR1752490 filed on 24 Mar. 2017, which is incorporated here in its entirety by reference.

The present invention concerns a circulator for circulating a refrigerant fluid in a circuit of a cryogenic installation of cryogenic loop type and a cryogenic installation of this type comprising this circulator.

Known in the prior art are cryogenic installations for cooling an element having a thermal load comprising a cryogenic machine of the "pulsed gas tube" type also known as a "pulse tube" and a circuit connecting the cryogenic machine and said element in which flows a refrigerant fluid such as helium or nitrogen.

In these installations, a refrigerant fluid of this kind is set in motion by a circulator the operation of which is controlled in particular on the basis of fluid flow rate measurements requiring the use of a thermal flowmeter disposed in the circuit of these installations. A circulator of this kind comprises a principal compartment in which is arranged an electric motor including a drive shaft supported by a bearing assembly of that motor comprising bearings having rolling bodies, said drive shaft having an end on which a centrifugal wheel is mounted. In this circulator, electrical cables for supplying power to the motor are connected to the latter via a sealed passage thus isolating a passage of this kind from the principal compartment in which the motor, the bearing assembly and the centrifugal wheel are immersed in the refrigerant fluid.

However, one of the disadvantages of the above cryogenic installations is linked to the fact that they are not suited to applications in which the refrigerant fluid must be maintained at so-called "low" cryogenic temperatures, which are below 10K. Actually, at such temperatures, the circulator has numerous dysfunctions and also generates high thermal losses in these cryogenic installations.

Actually, the electric motor of a circulator of this kind is configured to operate at an operating temperature that corresponds to the ambient temperature. As soon as that operating temperature approaches low cryogenic temperatures, the motor is then subject to operating anomalies that can be reflected for example in immobilization of the rotation movement of the drive shaft and therefore of the centrifugal wheel resulting from solidification at such temperatures of a lubricant used in the bearings having rolling bodies of the bearing assembly of that motor and clearances that are too small (thermal contractions).

Moreover, when the circulator operates at such low cryogenic temperatures, internal natural convection phenomena resulting from the circulation of the fluid in the principal compartment of this circulator generate very high thermal exchanges between the area of the compartment in which is located the motor at an average temperature 250K greater than the temperature in the area of this compartment where the centrifugal wheel is located. The consequence of these thermal exchanges is to generate considerable thermal losses in these cryogenic installations which then render the use of a circulator of this kind incompatible with the operation of these installations at such temperatures.

One object of the invention is therefore to remedy the disadvantages cited above and to improve the known prior art cryogenic installations. In particular, the invention proposes a cryogenic installation designed to operate in an optimal manner over a wide range of cryogenic temperatures, in particular at low cryogenic temperatures below or equal to 30K or less and for example of the order of 5K.

With this intention, the invention relates to a circulator for circulating a refrigerant fluid in a circuit of a cryogenic installation from and to an element having a thermal load, the circulator including a drive module and a pumping module including a centrifugal wheel, said drive module having a magnetic coupling to said pumping module in order to drive said centrifugal wheel in a rotary movement.

In other embodiments:

- the pumping module comprises a drive shaft including a magnetic rotor and said centrifugal wheel at a first end;
- the pumping module comprises a bearing assembly supporting a drive shaft of the centrifugal wheel comprising first and second bearings having rolling bodies, in particular cryogenic bearings having rolling bodies;
- the pumping module comprises an envelope defining a sealed enclosure containing a drive shaft of the centrifugal wheel;
- the envelope comprises a casing of the magnetic rotor and a volute casing;
- the drive module is an electric motor comprising a drive shaft having a free end comprising an element for supporting at least two magnetic elements of opposite polarity, in particular at least two permanent magnets;
- the support element is designed to surround a circumference of all or part of a casing of a magnetic rotor of an envelope of the pumping module in such a manner as to cooperate with said magnetic rotor;
- a magnetic rotor is arranged between first and second bearings having rolling bodies of a bearing assembly and mounted on a drive shaft of the centrifugal wheel;
- the drive module comprises a magnetic stator in particular including at least two electromagnets arranged around a circumference of all or part of a casing of a magnetic rotor of an envelope of the pumping module in such a manner as to cooperate with said magnetic rotor;
- the magnetic stator and the magnetic rotor mounted on the drive shaft together form an electric motor having operating characteristics substantially similar to those of a rotary motor, and
- the circulator is a minicirculator.

The invention also relates to a cryogenic installation for cooling an element having a thermal load comprising a circulator according to any one of the preceding claims for circulating a refrigerant fluid in a circuit of that cryogenic installation from and to said element.

The cryogenic installation advantageously comprises at least one cryogenic machine of pulsed gas tube type and a compression and control unit.

The cryogenic installation also advantageously comprises a cryostat including an enclosure in which an insulating vacuum is maintained.

In a particular manner, the cryostat comprises the circulator, the cryogenic machine and the circuit.

A circulator according to one aspect of the invention is defined by Claim 1.

Embodiments of this circulator are defined by Claims 2 to 7.

A cryogenic installation according to one aspect of the invention is defined by Claim 8.

Embodiments of this installation are defined by Claims 9 to 12.

Figure 2A:
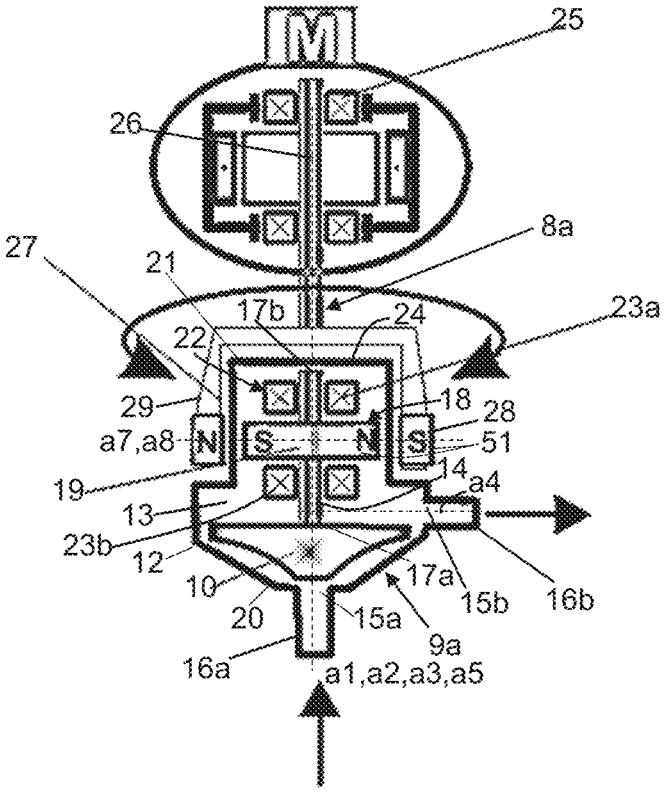
Figure 2B:
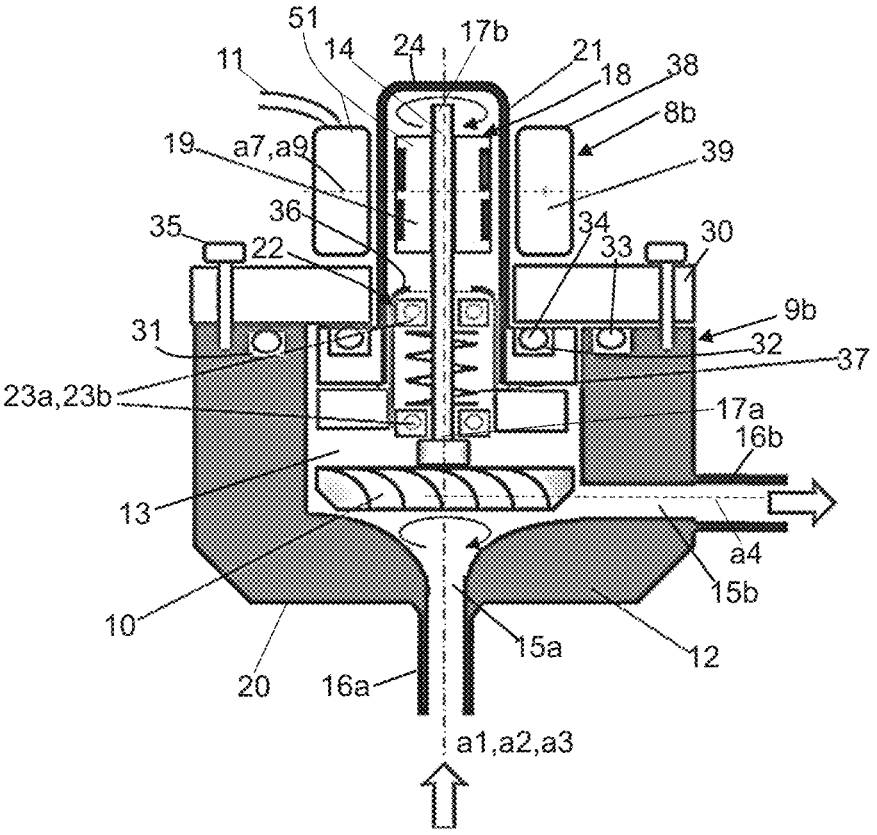

Other advantages and features of the invention will become more apparent on reading the following description of a preferred embodiment given by way of illustrative and nonlimiting example with reference to the figures:

FIG. 1 represents a cryogenic installation of cryogenic loop type in accordance with this embodiment of the invention for cooling an element receiving a thermal load, and FIGS. 2A and 2B represent diagrammatic views of drive and pumping modules of the first and second variants of the circulator in accordance with this embodiment of the invention.

In the following description, identical reference numbers designate parts that are identical or have similar functions.

There is described hereinafter with reference to FIG. 1 an embodiment of a cryogenic installation 1 according to the invention of cryogenic loop type for cooling an element 3 having a thermal load. A cryogenic installation 1 of this kind is configured to operate at all cryogenic temperatures, for example below 30 K or 25K, in particular at so-called "low" cryogenic temperatures, which are below 5K or 10K. In this cryogenic installation 1, the element 3 otherwise termed the "user" can be a device or an object to be cooled that generates or receives this thermal load.

The cryogenic installation 1 mainly comprises the element 3 having the thermal load, a circulator 2, a circuit 6 in which a refrigerant fluid 4 circulates and a cryogenic machine 5.

This cryogenic installation 1 also comprises a compression and control unit 7 connected to the cryogenic machine 5. This cryogenic installation 1 can comprise a cryostat 1A (shown schematically on FIG. 1) in which the following components of this installation 1 are located: the circulator 2, the cryogenic machine 5 and a part of the circuit 6. It will be noted that these components are of course connected to this circuit 6. A cryostat of this kind comprises an enclosure maintained under a dynamic vacuum also referred to as an "isolating vacuum" to minimize thermal losses by gaseous conduction and convection. It will be noted that this isolating vacuum of the cryostat surrounds the whole of the circulator 2 and therefore contributes to maintaining the circulator 2 at a substantially constant temperature corresponding to a low cryogenic temperature of for example 5K or even lower. It will be noted that the quality of the isolating vacuum required corresponds to what is commonly referred to as a "secondary vacuum", with a residual pressure level typically between $10^{-7}$ and $10^{-4}$ mbar inclusive.

In the cryostat, these components are mechanically fixed by parts such as fixing flanges that are made from a material of very low thermal conductivity enabling limitation of thermal leaks by thermal conduction.

In the cryogenic installation 1, the circuit 6 makes a thermal connection between the cryogenic machine 5 and the element 3 having the thermal load. A circuit 6 of this kind therefore contributes to conduction of this thermal load to the cryogenic machine 5 in order to evacuate it. To be more precise, when the element 3 generates this thermal load in the refrigerant fluid 4, the latter then causes an increase in the temperature of the fluid 4 related its specific heat and its mass flow rate. This increase in temperature of the refrigerant fluid 4 can however remain moderate depending on the magnitude of the mass flow rate of this fluid 4. When the refrigerant fluid 4 conveying the thermal load enters the cryogenic machine 5, it therefore cools on shedding this thermal load and departs for a new cycle. In this context, it will be noted that a circuit 6 of this kind is a closed heat transfer fluid loop that conveys the refrigerant fluid 4 between the cryogenic machine 5 and the element 3 having this thermal load.

In this circuit 6 of the cryogenic installation 1, the refrigerant fluid 4 can be a pressurized fluid of gas or liquid type that is maintained at a temperature below 5K. In the present embodiment, this refrigerant fluid 4 is a liquid such as supercritical helium at a pressure of approximately 20 bar.

In this cryogenic installation 1, the circuit 6 for circulating the refrigerant fluid 4 is connected to the cryogenic machine 5. This cryogenic machine 5 also termed a "cryorefrigerator" is preferably of the pulsed gas tube type also known as a "pulse tube". A machine of this kind is used to produce cryogenic temperatures below 120K. This cryogenic machine 5 comprises an exchange area also termed a "cold end" that is intended to evacuate the thermal load conveyed by the refrigerant fluid 4 coming from the element 3 that generated a load of this kind. In this embodiment, this cryogenic machine 5 is able to deliver a low refrigerating power between approximately 1 W and 10 W inclusive, depending on the required temperature level. The temperature delivered by the cryogenic machine 5 assumes an equilibrium that is a function of the thermal load to be evacuated. The circulator 2 adapts to the temperature/thermal load combination of the user 3.

As previously stated, the refrigerant fluid 4 is circulated in the circuit 6 by the circulator 2. This circulator 2 seen in FIG. 1 is preferably a minicirculator 2 also termed a "cold minicirculator" or "microcirculator". This circulator 2 is designed to create a pressure difference in the fluid 4 necessary to overcome the head losses caused by circulation thereof in the circuit 6. This circulator 2 is a small device of cylindrical general shape. It can have a length L between 70 and 100 mm inclusive, and preferably 70 mm, and a substantially circular section of the order of 50 to 60 mm and preferably 50 mm in diameter. A circulator 2 of this kind is particularly suitable for delivering a hydraulic power between 1 and 100 mW inclusive, and preferably of 10 mW. The circuit 6 will be sized to reduce this hydraulic power whilst retaining the capacity to transport the thermal load. Actually, this hydraulic power corresponds to the friction power of the fluid 5 on the walls, which is converted to heat, which has to be evacuated in addition to the thermal load of the user 3, and the other losses such as Foucault currents.

In the cryostat, this circulator 2 is preferably arranged as close as possible in the circuit 6 in the cryogenic machine 5 and in particular at the level of the exchange area of that machine 5. This circulator 2 mainly comprises a drive module 8*a*, 8*b* and a pumping module 9*a*, 9*b* including a centrifugal wheel 10 structurally designed to operate at cryogenic temperatures and electrical cables 11 supplying power to the drive module 8*a*, 8*b*. In this circulator 2, the drive module 8*a*, 8*b* has a magnetic coupling 51 to the pumping module 9*a*, 9*b* in order to drive the centrifugal wheel 10 in a rotary movement. The magnetic coupling 51 constitutes a component of the circulator 2 that comprises components 18, 28, 29, 38, 39 of that circulator 2 that are described hereinafter and contribute to the transmission of movement through an envelope 12 of the pumping module 9*a*, 9*b* of this circulator 2 without mechanical contact, without input of energy and without wear.

This pumping module 9*a*, 9*b* therefore comprises this envelope 12 which includes a sealed enclosure 13 containing a drive shaft 14 of the centrifugal wheel 10. A centrifugal wheel 10 of this kind is adapted to perform a rotary movement able to drive a circulation of the refrigerant fluid 4 in the circuit 6 and in particular in this enclosure 13. During this circulation, the refrigerant fluid 4 is then aspirated into this enclosure 13 at the level of an inlet opening 15*a* in the envelope 12 and evacuated via an outlet opening 15*b* of this enclosure 13. These openings 15*a*, 15*b* are connected to the circuit by inlet and outlet pipes 16*a*, 16*b* respectively of the circulator 2. It will be noted that the inlet opening 15*a* has an axis a1 that coincides with one of the central axes a2, a3 of the centrifugal wheel 10 and the drive shaft 14. In the case of the outlet opening 15*b*, it has an axis a4 that is preferably in a plane perpendicular to the axis a1 of the inlet opening 15*a*. In this envelope 12, the drive shaft 14 of the centrifugal wheel 10 has two ends 17*a*, 17*b* of which the first end 17*a* comprises this centrifugal wheel 10 fixed on by gluing, force fitting or screwing. This drive shaft 14 also includes a magnetic rotor 18 including at least one magnetic element 19 in particular a single cylindrical permanent magnet in particular a large permanent magnet or at least two permanent magnets of opposite polarity for example two small permanent magnets. The magnetic element 19 preferably has a magnetization that can have parameters depending on the torque required to drive the centrifugal wheel 10 in a rotary movement. In the present embodiment, this magnetization is partial because the torque required is low because the hydraulic power needed is low and likewise the mechanical power to be exerted on the drive shaft 14. It will be noted that if the chosen magnetization is total instead of partial, the magnetic volume of the magnets is limited accordingly.

This envelope 12 of the pumping module 9*a*, 9*b* comprises a volute casing 20 and a casing 21. This casing 21, also termed a "bell" or "sealing bell", is designed to house the magnetic rotor 18 mounted on the drive shaft 14 and constitutes a part of the envelope 12 having the general shape of a cylindrical tube. This casing 21 has characteristics linked to low generation of Eddy currents when it is exposed to a varying magnetic field. It is preferably thin as described hereinafter. Moreover, it has properties of resistance to the internal pressure in particular to pressures below 50 bar. Additionally, this casing 21 is made of a metal material having low electrical conductivity properties, for example stainless steel or a titanium alloy maintaining a low electrical conductivity over all the range of operating temperatures, including at 5K. It will be noted that this metal material has a non-laminated structure, incompatible with the required seal.

The volute casing 20 comprises inlet and outlet openings 15*a*, 15*b* of the enclosure 13 of this envelope 12. This volute casing 20 defines a part of the enclosure 13 of the envelope 12 in which is arranged the centrifugal wheel 10 situated at the first end 17*a* of the drive shaft 14. In the case of the casing 21, it also defines a part of the enclosure 13 of this envelope 12 in which is located the magnetic rotor 18 mounted on the drive shaft 14.

The pumping module 9*a*, 9*b* also includes a bearing assembly 22 also termed a "bearing unit" supporting the drive shaft 14 of the centrifugal wheel 10 and situated in the envelope 12 in part in the volute casing 20 and in the casing 21. This bearing assembly 22 is in particular designed to absorb the forces resulting from the rotation of this drive shaft 14 including the centrifugal wheel 10. This bearing assembly 22 comprises two bearings having rolling bodies 23*a*, 23*b* or groups of bearings having rolling bodies referred to hereinafter as the first and second bearings having rolling bodies 23*a*, 23*b*. These bearings having rolling bodies 23*a*, 23*b*, which are precision bearings having rolling bodies, can be of any appropriate known kind adapted to operate at cryogenic temperatures, in particular below 5K, and to withstand an axial load and a radial load, for example cold bearings having rolling bodies also termed cryogenic bearings having rolling bodies. These bearings having rolling bodies 23*a*, 23*b* enable the drive shaft 14 to be supported, guided and centred in the envelope 12 of the pumping module 9*a*, 9*b*.

In the circulator 2, the envelope 12 and in particular the casing 21 delimits the enclosure 13 of this circulator 2. The drive module 8*a*, 8*b* of this circulator 2 is arranged in this part.

Referring to FIGS. 1, 2A and 2B, this circulator 2 can be produced in accordance with two variants in which the drive and pumping modules 8*a*, 8*b*, 9*a*, 9*b* are different.

In the first variant, the drive and pumping modules 8*a*, 9*a* of which can be seen in FIG. 2A, the envelope 12 can result from a sealed assembly of the volute casing 20 with the casing 21 or be a one-piece component. The drive shaft 14 of the pumping module 9*a* arranged in this envelope 12 extends from the top 24 of this casing 21 toward the inlet opening 15*a* supported by the bearing assembly 22 comprising the first and second bearings having rolling bodies 23*a*, 23*b*. In this variant, these first and second bearings having rolling bodies 23*a*, 23*b* are preferably cold bearings having rolling bodies. On this drive shaft 14, the first bearing having rolling bodies 23*a* is mounted at the second end 17*b* of the drive shaft 14. On this drive shaft 14, these first and second bearings having rolling bodies 23*a*, 23*b* are arranged so that an offset is defined between them for the arrangement of the magnetic rotor 18 on the drive shaft 14. In other words in this variant the magnetic rotor 18 is arranged between these two bearings having rolling bodies 23*a*, 23*b*. It will be noted that in this configuration the magnetic rotor 18 and all or part of the bearing assembly 22 are arranged in the casing 21 of the envelope 12.

In this variant, the drive module 8*a* includes an electric motor 25 connected to an electrical power supply by electrical cables 11. This motor 25 can be chosen from prior art electric motors such as alternating current motors or direct current motors including brushes or brushless direct current motors or stepper motors. This motor 25 comprises a drive shaft 26 with a free end comprising an element 27 supporting at least two magnetic elements 28 of opposite polarity, in particular at least two permanent magnets. This drive shaft 26 has a central axis a5 that coincides with the axis a3 of the drive shaft 14. This support element 27 is designed to surround the circumference of all or part of the casing 21. This support element 27 can be of circular or tubular shape, for example a dome, a cupola, a blind tube or a ring. Each magnetic element 28 is arranged on a lateral part 29 of this support element 27 facing a peripheral wall of the casing 21, so that central axes a7, a8 of each magnetic element 28 and the magnetic rotor 18 coincide. In other words, in an arrangement of this kind, each magnetic element 28 and the magnetic rotor 18 are aligned with one another along these central axes a7, a8. It will be noted that in this context the casing 21 has a small thickness between 300 and 600 μm inclusive, and preferably 300 μm, so that the generation of Eddy currents is minimized. The airgap present between the magnetic rotor 18 and each magnetic element 28 of the support element 27 must be sufficiently small, for example of the order of a few millimetres maximum, in order to provide the magnetic coupling 51 between the drive and pumping modules 8*a*, 9*a*.

Thus in this configuration the drive and pumping modules 8*a*, 9*a* have a magnetic coupling 51 to one another via the support element 27 including at least two magnetic elements 28 of opposite polarity connected to the motor 25 by the drive shaft 26 and the magnetic rotor 18 mounted on the drive shaft 14 of the centrifugal wheel 10. Actually, each magnetic element 28 of the support element 27 when rotated by the motor 25 of the drive module 8*a* causes the centrifugal wheel 10 to rotate, having a magnetic coupling 51 to the magnetic rotor 18.

In the second variant, the driving and pumping modules 8*b*, 9*b* of which can be seen in FIG. 2B, the envelope 12 is formed by assembling the volute casing 20 and the casing 21. The casing 21 of the magnetic rotor 18 and the volute casing 20 are assembled together in such a manner as to define the enclosure 13 of the envelope 12. To this end, the volute casing 20 and the casing 21 each comprise an area connected to the corresponding fixing flange 30 defined in the cryostat. The connecting area includes a groove 31, 32 in which a sealing element 33, 34 of O-ring type is located in such a manner that the sealing element 33, 34 is located between this connecting area and the flange 30. It will be noted that this O-ring can be from the HELICOFLEX™ seal family capable of providing a seal at cryogenic temperatures.

The connecting area of the volute casing 20 is mechanically connected to the flange 30 by connecting elements 35 such as bolts. The titanium alloy sealing bell 21 is welded to the flange 30 or machined in the latter.

The drive shaft 14 of the pumping module 9*b* arranged in this envelope 12 extends from the top 24 of the casing 21 toward the inlet opening 15*a* supported by the bearing assembly 22 comprising the first and second bearings having rolling bodies 23*a*, 23*b*. This bearing assembly 22 includes a support component 36 in which are located these first and second bearings having rolling bodies 23*a*, 23*b* and a prestressing spring 37 that holds them axially away from each other in this component 36. This support component 36 is mounted in part in the casing 21 in such a manner as to be retained in a fixed position. This support component 36 is located on the drive shaft 14 between the magnetic rotor 18 and the centrifugal wheel 10. In this variant this centrifugal wheel 10 and this magnetic rotor 18 are respectively mounted at the first and second ends 17*a*, 17*b* of the drive shaft 14. It will be noted that in this configuration the magnetic rotor 18 and all or part of the bearing assembly 22 are arranged in the casing 21.

In this variant, the drive module 8*b* includes a magnetic stator 38 that can comprise at least two electromagnets 39 enabling a magnetic field to be created rotating about the circumference of the casing 21 in such a manner as to cooperate with the magnetic rotor 18. The magnetic stator 38 is arranged at the level of the peripheral wall of this casing 21, in such a manner that the central axes a7, a9 of this magnetic stator 38 and of the magnetic rotor 18 coincide. In other words, in an arrangement of this kind, the magnetic stator and the magnetic rotor 38, 18 are aligned with one another along these central axes a7, a9. In this context, it will be noted that the casing 21 has a small thickness between 300 and 600 μm inclusive, preferably 300 μm, so that the generation of Eddy currents is minimized. The air gap present between the magnetic rotor 18 and the magnetic stator 38 must be sufficiently small, for example of the order of a few millimetres maximum, to ensure sufficient magnetic coupling.

This magnetic stator 38 is connected to an electrical power supply via electrical cables 11. It will be noted that the electrical power supply enabling variation of the rotary movement of the centrifugal wheel 10 can be controlled with or without a rotary position sensor. In particular, known prior art sensorless technologies based on measurement of electrical parameters and/or parameters varying as a function of the position of the rotor can be employed in the present invention. It will be noted that the Hall effect probes conventionally used as position sensors in brushless motors do not work at low temperature.

It will be noted that in this configuration in this variant of the circulator 2 the magnetic stator 38 and the magnetic rotor 18 mounted on the drive shaft 14, although separated by the sealing bell 21, together form an electric motor, in particular a motor having operating characteristics that are similar to those of a rotary motor in particular a brushless motor type synchronous motor.

Thus, in this second variant, the drive and pumping modules 8*b*, 9*b* are magnetically coupled to one another by way of the magnetic stator 38 that is able to generate a field rotating in the direction of the magnetic rotor 18 mounted on the drive shaft 14 in order to cause the centrifugal wheel 10 to rotate.

In the second variant, the rotor of the motor is immersed in the fluid. This is made possible by interposing the casing 21 (or sealed bell) between the rotor and the stator. This makes it possible to simplify the magnetic coupling. Everything proceeds as if an external magnetic coupler bell and its motor for setting in rotation were replaced by a single brushless motor stator.

Preferably, in the second variant, the casing 21 (or sealed bell) is optimized. In particular, its thickness is reduced as far as the resistance to the internal pressure allows. The casing is for example made of metal, in particular of stainless steel or titanium. The material of the casing is chosen to be as resistive as possible according the temperature range in order to withstand the development of thermal load-generating Foucault currents. The sealed casing 21 between the rotor and the stator is for example made of a material with an electrical resistivity above $0.5\mu\Omega\cdot m^{-1}$ at the working temperature, that is to say at a temperature below 30K, or even below 25K. An electric insulating material will advantageously be used from the moment that the required sealing at cryogenic temperature is obtained (typically below 30K, or even below 25K), the circulator being surrounded by a secondary vacuum at $10^{-6}$ mbar.

The sealed casing 21 between the rotor and the stator preferably has a diameter which is as low as possible (to limit the Foucault currents), ideally below or equal to 12 mm.

The sealed casing 21 between the rotor and the stator has a thickness which is as small as possible (to limit the Foucault currents), for example lower or equal to 0.5 mm.

Preferably, in the second variant, the stator operates under the same vacuum as stated above, namely of the order of $10^{-6}$ mbar. The thermal power of the stator (due to the Joule effect and to various magnetic losses) is therefore, for example, evacuated by contact of the stator with the casing 21, itself in thermal contact with the cryogenic fluid. For that purpose, the stator is advantageously mounted just sliding on the casing. Thus, the stator comprises a bore in which the casing 21 is housed. For example, a clearance below or equal to 0.05 mm can be provided between the casing and the stator, in particular between the casing and the bore of the stator. This reduced clearance makes it possible to ensure good heat transfer between the rotor and the casing 21. The bore of the stator can be produced by moulding a synthetic material, for example an epoxy resin, in particular Stycast®. The synthetic material can be filled with a constituent of high thermal conductivity to improve its thermal conductivity.

Preferably, in the second variant, the speed of rotation of the rotor is deliberately greatly reduced to reduce the Foucault currents developed in the casing 21. For example, the speed of rotation is as low as possible (to limit the Foucault currents). In particular, the speed of rotation is ideally below 50 Hz. However, it remains compatible with the production of a sufficient mass flow rate of cryogenic fluid.

Preferably, in the second variant, the stator/rotor gap is deliberately increased and/or the magnetization of the magnets deliberately reduced to withstand the Foucault currents. The design of the motor is here unconventional since it has not sought to obtain a motor with the greatest possible performance or with the greatest possible efficiency for a given electrical energy quantity. It is sought here to obtain a motor which disturbs the heat-transfer loop as little as possible, that is to say which heats the cryogenic fluid as little as possible. For example, the rotor-stator gap is larger than strictly necessary to house the sealed casing there in order to reduce the value of the magnetic field at the casing. This makes it possible to limit the Foucault currents. For example, the rotor-stator gap is above 3 mm.

Preferably, in the second variant, with the same aim, the diameter of the rotor is limited (to limit the Foucault currents). For example, the diameter of the rotor is below or equal to 6 mm. The limitation of the magnetic volume must remain compatible with the production of a sufficient mechanical torque for starting the centrifugal wheel, the residual friction in the bearing assembly, and the hydraulic resistant torque. Advantageously, the rotor comprises a dipolar magnet of small diameter, for example below 6 mm. The presence of only two poles relatively distant (for example between 2 and 3 mm) for the sealed casing makes it possible to limit (at a given speed of rotation) the production of Foucault currents by minimizing the magnetic field variations experienced by the casing.

Preferably, in the second variant, the motor is of the "brushless" type having a rotor with permanent magnets. The operation at cryogenic temperatures renders inoperative a control of the motor that is based on Hall-effect sensors. The motor is therefore preferably controlled "in open loop".

In the different variants, the construction of the guide bearing of the centrifugal wheel is a critical element. Specifically, the low temperatures prevent any conventional lubrication. Thus, the bearing is preferably constructed with dry bearing having rolling bodies, the dry bearing being mounted in rings made of polychlorotrifluoroethylene, in particular of Kel-F® or Neoflon®, or of Vesper), to maintain some flexibility with respect to the differential contraction of the various materials during the setting to very low temperature (typically below 30K).

Preferably, in the second variant, the pivot mechanism is constituted by two bearings having rolling bodies of "cryogenic" type. The clearances in these bearings having rolling bodies at ambient temperature (300K) are large and are reduced by contraction of the components to arrive at an optimum value for good operation at the cryogenic working temperature (typically below or equal to 30K). The optimal operating clearance minimizes the rotational resistance torque of the centrifugal wheel and maximizes the service life. These bearings having rolling bodies are chosen with a size which is as small as possible, ideally with a diameter below 7 mm, in order to limit the frictional torque and the need for drive torque. The bearings having rolling bodies are advantageously of the type with a deep groove and with an O-type mounting. Of course, these bearings having rolling bodies could also be ones with an X-type mounting.

Preferably, in the second embodiment, the spring 37 exerts an axial preload on the two bearings having rolling bodies, in particular an axial preload of 1 N. The stiffness of the spring is chosen such that, upon setting to very low temperature (typically below 30K), the value of this precharge does not vary by more than 10% subsequent to the dimensional variations.

Preferably, in the second embodiment, the mounting of the rotor is of the "cantilever" type, that is to say that the rotor is mounted in an overhanging fashion with respect to the two bearings having rolling bodies.

Preferably, in the second embodiment, unlike certain industrial circulators in which the motor remains at ambient temperature when the wheel and the volute casing are at cryogenic temperature, the circulator constitutes an isothermal or substantially isothermal assembly operating at the cryogenic working temperature (typically below or equal to 30K). The circulator is advantageously installed at the same level or at the same altitude as the cold source, in particular at the cold end 5' of the cryogenic machine of the "pulsed gas tube" type. Moreover, the circulator is advantageously coupled thermally to the cold source. This coupling can be achieved by a copper bar. The circulator is thus permanently maintained at the lowest temperature and the wheel thus always drives the coldest and the densest fluid. Cut-offs of the circulator and/or the formation of gaseous "plugs" at the bottom points of the circuits are thus avoided.

It will be noted that in the first variant of the circulator 2 the magnetic coupling 51 comprises said at least two magnetic elements 28 of opposite polarity arranged in the support element 27 and the rotor 18 mounted on the drive shaft 14. Where the second variant is concerned, this magnetic coupling 51 comprises the magnetic stator 38 arranged at the level of the peripheral wall of this casing 21 and the rotor 18.

Moreover, in these two variants of the circulator 2, the centrifugal wheel 10 in executing a rotary movement in this way generates the circulation of the refrigerant fluid 4 in the circuit 6 of the cryogenic installation 1, and the fluid 4 is then aspirated through the inlet opening 15*a* to circulate in the enclosure 13 of the envelope 12 and to be evacuated from the latter via the outlet opening 15*b* to the cryogenic machine 5. When the refrigerant fluid 4 circulates in the enclosure 13, the drive shaft 14, the magnetic rotor 18 and the bearing assembly 22 with its bearings having rolling bodies 23*a*, 23*b* are then immersed in this fluid 4.

The invention therefore contributes to improving the operation of the cryogenic installation 1 at cryogenic temperatures below 120K, in particular by reducing the thermal losses caused by the circulator 2. Moreover, in this invention, the circulator 2 can be configured to operate in a cryogenic installation 1 in which the hydraulic power required and the mechanical power that has to be exerted on the drive shaft 14 are low.

The invention claimed is:

1. A circulator for circulating a refrigerant fluid in a circuit of a cryogenic installation from and to an element having a thermal load, the circulator including:

a drive module including a magnetic stator, and a pumping module including a magnetic rotor and a centrifugal wheel, wherein the stator of the drive module is magnetically coupled to the rotor of the pumping module in order to drive the centrifugal wheel in a rotary movement, and wherein the pumping module comprises an envelope defining a sealed, thermal loss-reducing enclosure containing a drive shaft of the centrifugal wheel, the envelope comprising a casing of the magnetic rotor and a volute casing, wherein the magnetic stator of the drive module is arranged outside of the envelope of the pumping module so as to cooperate with the magnetic rotor arranged inside of the envelope.

2. The circulator according to claim 1, wherein the pumping module comprises the drive shaft including the magnetic rotor and the centrifugal wheel at a first end.

3. The circulator according to claim 2, wherein the pumping module comprises a bearing assembly supporting the drive shaft of the centrifugal wheel and comprising first and second bearings having rolling bodies.

4. The circulator according to claim 3, wherein the magnetic rotor is arranged outside the first and second bearings having rolling bodies of the bearing assembly and mounted on the drive shaft of the centrifugal wheel.

5. The circulator according to claim 2, wherein the magnetic stator is arranged around a circumference of all or part of the casing of the magnetic rotor.

6. The circulator according to claim 5, wherein the magnetic stator and the magnetic rotor mounted on the drive shaft together form an electric motor.

7. The circulator according to claim 1, wherein the pumping module comprises a bearing assembly supporting the drive shaft of the centrifugal wheel and comprising first and second bearings having rolling bodies.

8. The circulator according to claim 7, wherein the magnetic rotor is arranged outside the first and second bearings having rolling bodies of the bearing assembly and mounted on the drive shaft of the centrifugal wheel.

9. The circulator according to claim 7, wherein the first and second bearings are cryogenic bearings.

10. The circulator according to claim 1, wherein the magnetic stator is arranged around a circumference of all or part of the casing of the magnetic rotor.

11. The circulator according to claim 10, wherein the magnetic stator includes at least two electromagnets.

12. The circulator according to claim 10, wherein the magnetic stator and the magnetic rotor mounted on the drive shaft together form an electric motor.

13. The circulator according to claim 12, wherein the electric motor is a brushless synchronous electric motor.

14. The circulator according to claim 1, wherein the circulator is a minicirculator.

15. A cryogenic installation for cooling an element having a thermal load, the installation comprising the circulator according to claim 1 configured for circulating a refrigerant fluid in a circuit of the cryogenic installation from and to the element.

16. The cryogenic installation according to claim 15, wherein the installation comprises at least one cryogenic machine of pulsed gas tube type and a compression and control unit.

17. The cryogenic installation according to claim 15, wherein the installation comprises a cryostat including an enclosure in which an insulating vacuum is maintained.

18. The cryogenic installation according to claim 17, wherein the installation comprises at least one cryogenic machine of pulsed gas tube type and a compression and control unit, and wherein the cryostat comprises the circulator, the cryogenic machine and the circuit.

19. The cryogenic installation according to claim 15, wherein the installation comprises a cold source, the circulator being mounted at a same level or at a same altitude as the cold source.

20. The cryogenic installation according to claim 19, wherein the cold source is a cold end of a cryogenic machine of pulsed gas tube type, and wherein the centrifugal wheel is mounted at a same level or at a same altitude as the cold end of the cryogenic machine of pulsed gas tube type.

* * * * *